US008562290B2

(12) United States Patent
Strock et al.

(10) Patent No.: US 8,562,290 B2
(45) Date of Patent: Oct. 22, 2013

(54) BLADE OUTER AIR SEAL WITH IMPROVED EFFICIENCY

(75) Inventors: Christopher W. Strock, Kennebunk, ME (US); Matthew E. Bintz, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 874 days.

(21) Appl. No.: 12/752,185

(22) Filed: Apr. 1, 2010

(65) Prior Publication Data

US 2011/0243716 A1 Oct. 6, 2011

(51) Int. Cl.
*F01D 11/12* (2006.01)

(52) U.S. Cl.
USPC ..... 415/173.1; 428/698

(58) Field of Classification Search
USPC ..... 415/173.1, 173.4; 428/698
See application file for complete search history.

(56) References Cited

U.S. PATENT DOCUMENTS

| | | | |
|---|---|---|---|
| 4,696,855 | A | 9/1987 | Pettit, Jr et al. |
| 4,741,973 | A | 5/1988 | Condit et al. |
| 4,783,341 | A | 11/1988 | Packer et al. |
| 4,936,745 | A | 6/1990 | Vine et al. |
| 5,024,884 | A | 6/1991 | Otfinoski |
| 5,314,304 | A | 5/1994 | Wiebe |
| 5,536,022 | A | 7/1996 | Sileo et al. |
| 5,704,759 | A | 1/1998 | Draskovich et al. |
| 5,705,231 | A | 1/1998 | Nissley et al. |
| 5,780,116 | A | 7/1998 | Sileo et al. |
| 6,102,656 | A | 8/2000 | Nissley et al. |
| 6,365,222 | B1 | 4/2002 | Wagner et al. |
| 6,537,021 | B2 | 3/2003 | Howard et al. |
| 6,887,530 | B2 | 5/2005 | Fiala et al. |
| 7,160,352 | B2 | 1/2007 | Le Biez et al. |
| 7,582,362 | B2 | 9/2009 | Fiala et al. |
| 2008/0167173 | A1 | 7/2008 | Lima et al. |
| 2009/0136740 | A1 | 5/2009 | Reynolds et al. |

*Primary Examiner* — Dwayne J White

(74) *Attorney, Agent, or Firm* — Carlson, Gaskey & Olds P.C.

(57) ABSTRACT

An air seal for use with rotating parts in a gas turbine engine has a matrix of agglomerated fine hBN (hexagonal boron nitride) powder, the particles of which having a first dimension, and of a fine metallic alloy powder, the particles of which having a second dimension. An hBN (hexagonal boron nitride) powder, the particles of which have a third dimension that is greater than the first dimension, is mixed with the matrix.

21 Claims, 2 Drawing Sheets

BLADE OUTER AIR SEAL WITH IMPROVED EFFICIENCY

BACKGROUND OF THE INVENTION

With components of rotary machinery, such as a gas turbine engine, a consistent roundness (defined as a constant radius about a point or an axis) is difficult to obtain. A relatively inflexible cylindrical part, like a rotor, can be made very close to round but the part may be subject to material flaws and malformations, handling and assembly, and operating parameters that affect the constancy of its defining radii fairly constantly throughout the part.

Relatively flexible parts, like a blade or a casing complicate the issue because of their greater susceptibility to damage and motion during manufacture, assembly and use. For example, as blades rotate about a rotor, their rotating blade tips define a desired substantially cylindrical envelope in which the blades rotate. However, the blade lengths may not be equal, the blade radii (and their supports) lengthen and shorten as engine operating temperatures vary and the blades may flex under load.

Similarly, a thin, relatively flexible, stationary casing is disposed around the substantially cylindrical envelope. For efficiency, it is desired that this casing be closely aligned with the envelope to prevent air or other gasses from escaping around the blade tips. However, the casing may not react to temperature changes in the engine in the same manner as the blades and the rotors and is subject to other loads in the engine. Control systems may be used in the engine to keep the casing closely aligned with the cylindrical envelope. Such systems, however, may not be perfect and some blade tip-to-casing interference may occur.

During operation, especially when the engine is newer, the engine may define for itself its own definition of roundness and minimize out of roundness as parts interact and contact each other. Abradable coatings are used to protect the parts as interaction occurs. Some blades have coatings or tip treatments that affect the wear of the blades during operation.

SUMMARY

According to an exemplar, an air seal for use with rotating parts in a gas turbine engine has a matrix of agglomerated fine hBN (hexagonal boron nitride) powder, the particles of which have a first dimension, and of a fine metallic alloy powder, the particles of which have a second dimension. A hBN (hexagonal boron nitride) powder, the particles of which have a third dimension that is greater than the first dimension, is mixed with the matrix.

According to a further exemplary, a gas turbine engine has an air seal disposed between relatively rotating parts. The air seal has a matrix of agglomerated fine hBN (hexagonal boron nitride) powder, the particles of which have a first dimension, and of a fine metallic alloy powder, the particles of which have a second dimension. A hBN powder, the particles of which have a third dimension that is greater than the first dimension, is mixed with the matrix.

According to a still further exemplar, a method of creating an air seal on a gas turbine engine part includes agglomerating a matrix of fine hBN (hexagonal boron nitride) powder, the particles of which having a first dimension and of a fine metallic alloy powder, the particles of which having a second dimension and mixing with the matrix an hBN (hexagonal boron nitride) powder, the particles of which having a third dimension that is greater than the first dimension.

These and other features of the present invention can be best understood from the following specification and drawings, the following of which is a brief description.

DETAILED DESCRIPTION OF THE PREFERRED EMBODIMENT

Figure 1:
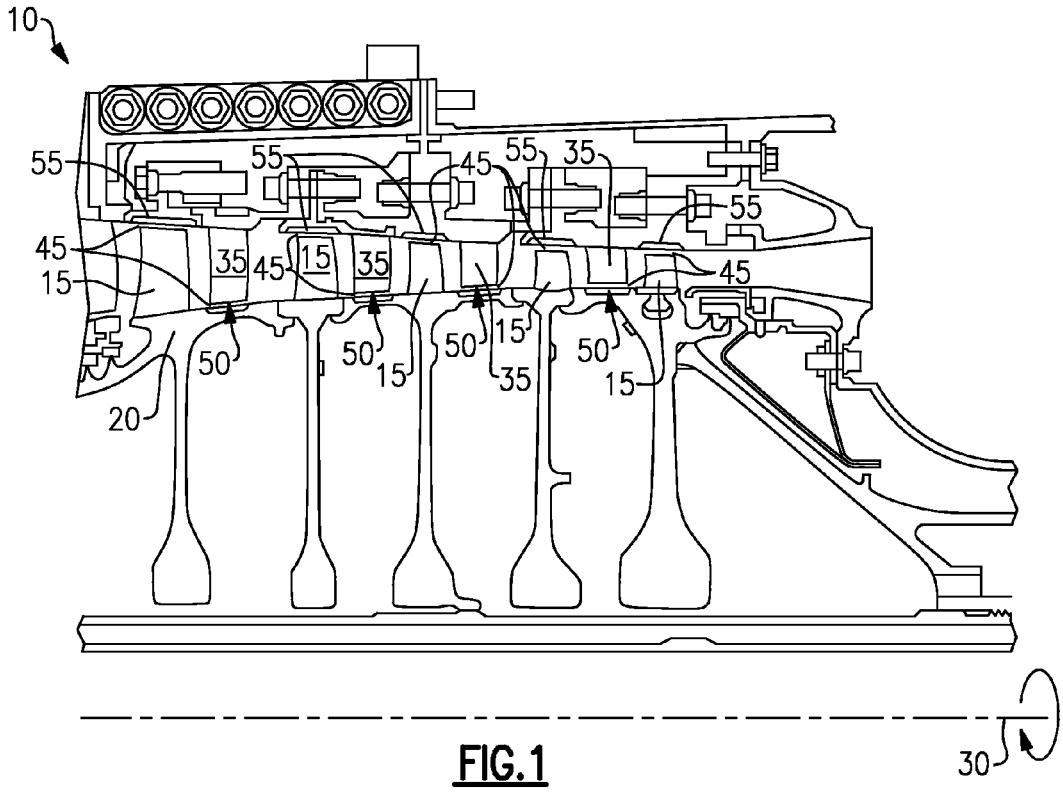
FIG. 1 shows a prospective view of a gas turbine engine incorporating an air seal.
Figure 2:
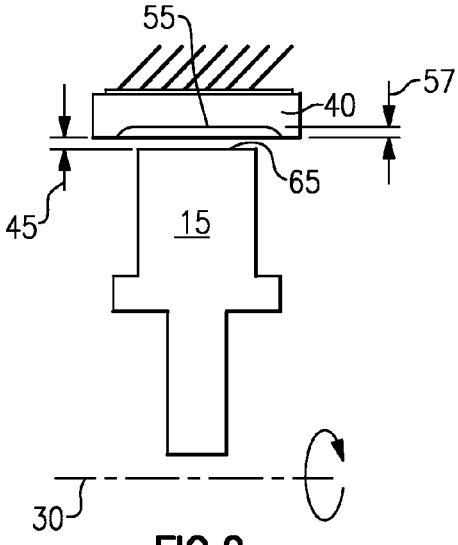
FIG. 2 shows a schematic view of a blade and an outer air seal of FIG. 1.
Figure 3:
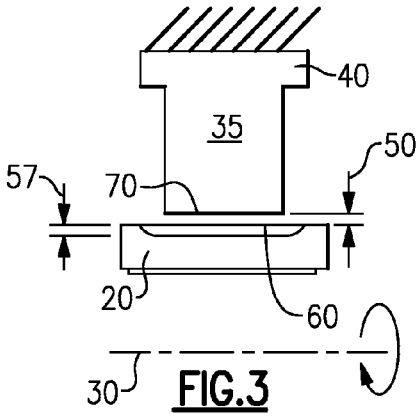
FIG. 3 shows a schematic view of a vane and an inner air seal of FIG. 1.

FIG. 1 shows a portion of a case turbine engine 10 having a plurality of blades 15 that are attached to a hub 20 and rotate about an axis 30. Stationary vanes 35 extending from a casing 40 (FIG. 2) are interspersed between the turbine blades 15. A first gap 45 exists between the blades and the casing (see also FIG. 2) and a second gap 50 exists between the vanes 35 and the hub 20. First air seals 55 are deposited on the casing adjacent the blades 15 (see also FIG. 2) and second air seals 60 may be deposited on the hub 20 adjacent the vanes 35 (see FIG. 3). Blades 15 rotate relative to stationary first seals 55 and hub 20 rotates relative to stationary vanes 35. It should be recognized that the seal provided herein may be used with any of a compressor, fan or a turbine blade or with stationary air directing vanes. It is desirable that the gaps 45, 50 be minimized and interaction between the blades 15 and seal 55 and vanes 35 and seals 60 occur to minimize air flow around blade tips 65 or vane tips 70.

Prior art air seal materials (not shown) have either been designed for use with hard or abrasive blade tip treatments, or for use with bare Ti (Titanium), Ni (Nickel) or Fe (Iron) based blade tips. These arrangements typically exhibit wear ratios between the blade tips and air seal materials that are undesirable. With tipped blades, the wear is localized in the outer air seal, while with untipped blades, there is excessive wear in the blade tips, or blade material transfers to the seal thereby degrading the seal.

While engine dimensions and tolerances may vary, a balance of wear results between a blade and a seal with which it interacts resulting in a wear ratio. If the ratio is too high, e.g., the blade wears too much relative to the seal, the blade may need to be overhauled or replaced too early relative to other wear in the blade exposing an engine user to greater expense. Similarly if the ratio is too low, the seal may need to be replaced too often also causing additional expense to the engine user. Ideally, the blade 15 will wear an amount and the seal 55 will wear an amount to minimize expense and downtime to run the engine 10.

In the instant application, as an example, an optimum balance of wear between the blade 15 and seal 55 is about 0.25 for blade tip wear over seal wear. That is for about every 2 mils of linear blade 15 wear, the seal 55 will wear at a depth of about 8 mils. This ratio also reflects the relative amount of out of roundness that needs to be corrected by wear of blades 15 and seal 55. Depending on the shape of the blades 15, a volumetric (as opposed to a linear ratio as described hereinabove as ~0.25) may also be used. While an ideal ratio for blades 15 and seal 55 is described for this engine 10, a user will understand that an ideal ratio is also desired and contemplated herein between a vane 35 and a seal 60 or other part rotating relative to the vane 35 or the like.

This linear wear ratio of ~0.25 is a large ratio in the context of currently available coatings. Existing materials that do achieve wear ratios close to this level suffer from aerodynamic losses due to high gas permeability and high surface roughness in the air seals. Applicants have discovered that there is a need for an abradable blade outer air seal that can be used without costly hard coated or abrasive blade tip treatments while achieving optimal wear ratio with bare blade tips, has a smooth surface, low gas permeability and results in optimal efficiency.

An abradable air seal 55, 60 for use in conjunction with Ti, Fe or Ni based blades without abrasives added to their tips provides low blade tip wear, a smooth surface and low gas permeability for improved aerodynamic efficiency is described hereinbelow.

The material is a bimodal mix of a fine composite matrix of metallic based alloy (such as a Ni based alloy though others such as cobalt, copper and aluminum are also contemplated herein) and hexagonal boron nitride ("hBN"), and inclusions of hBN. Feed stock used to provide the air seals 55, 60 is made of composite powder particles of Ni alloy and hBN held together with a binder, plus hBN particles that are used at a variable ratio to the agglomerated composite powder to adjust and target the coating properties during manufacture. One of ordinary skill in the art will recognize that other compounds such as a relatively soft ceramic like bentonite clay may be substituted for the hBN.

The fine composite matrix, of Ni based alloy and hexagonal boron nitride (hBN) includes hBN particles in the range 1-10 micron particle sizes and the Ni based alloy in the range of 1-25 microns particle size. Polyvinyl alcohol may be used as a binder to agglomerate the particles of Ni based alloy and hBN before thermal spraying. Alternatively, the Ni based alloy may be coated upon the hBN before thermal spraying. If the particles are not agglomerated in some way, they may cake up, distort or react inappropriately during spraying.

Larger particles of hBN are added to the fine composite matrix prior to spraying or during spraying. The larger hBN particles are in the range of 15-100 microns particle size though 20-75 microns particle size may be typical. The ratio between the amount by volume of hBN to Ni alloy is about 40-60%.

Figure 4:
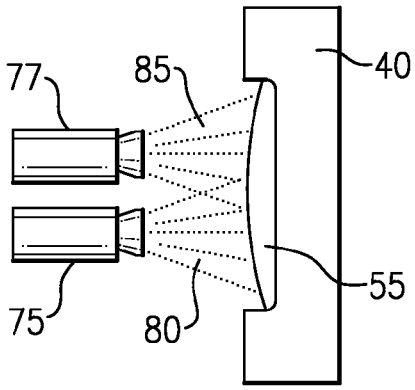
FIG. 4 is a schematic view of a method of applying a seal to a stationary part.
Figure 5:
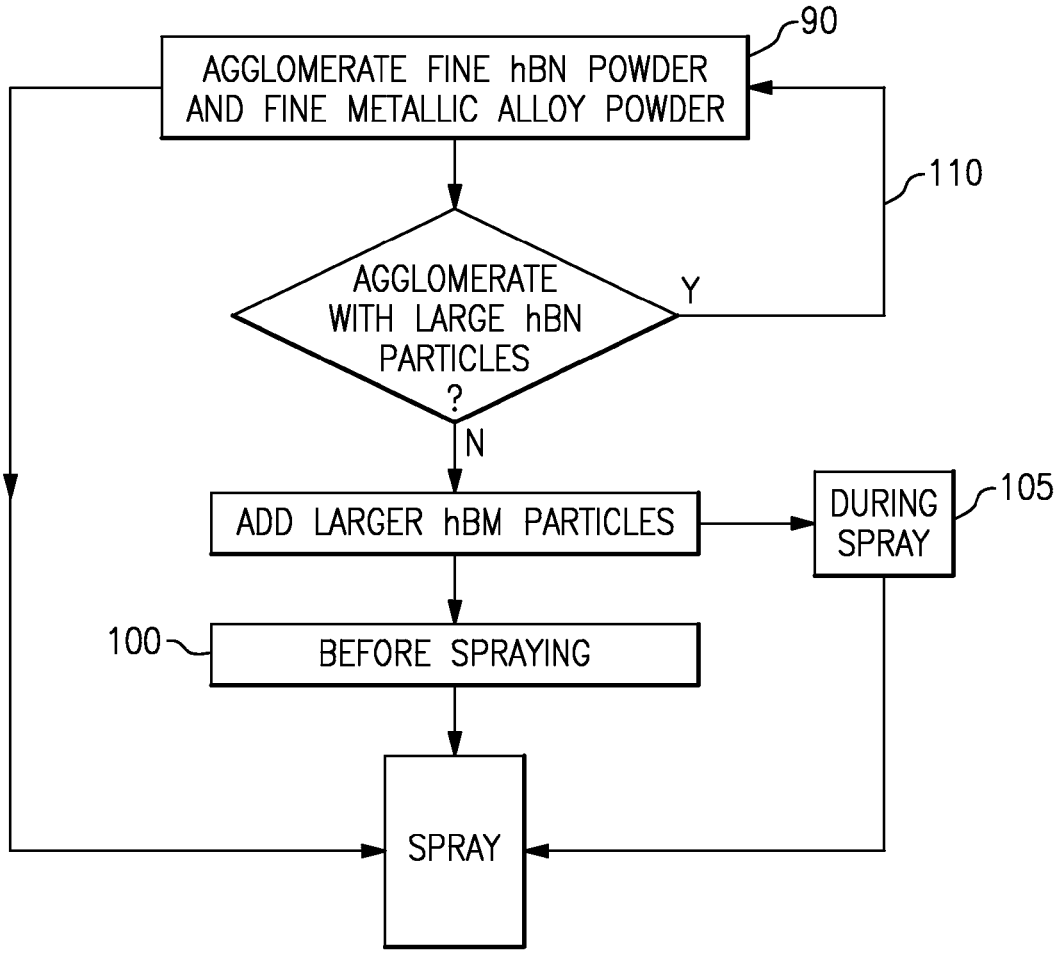
FIG. 5 is a schematic view of a method of mixing an air seal.

Referring to FIGS. 4 and 5, the powders are deposited by a known thermal spray process. Nozzle 75 may spray the matrix 80 of agglomerated hBN powder and Ni alloy and the nozzle 77 may spray the larger particles of hBN 85 in a thermal spray environment to combine and build up the air seal 55 to an appropriate depth 57 of between 5 and 150 mils. Conversely, the matrix of hBN and Ni alloy may be mixed with the larger hBN particles prior to spraying and one nozzle, for instance 77 may then only be necessary. The powders may be blended before spraying or fed separately into the plasma plume.

Referring to FIG. 5, step 90, fine particle-sized hBN powders and the fine particle-sized Ni alloy powders to agglomerated as stated. The larger particle-sized hBN particles may be added during agglomeration (step 90) either before spray (step 100) or during spray (step 105). However, it is also possible to include the larger hBN particles in the agglomerates of matrix material (step 110).

Low blade tip wear is achieved by reducing the volume fraction of metal in the mix of the coating relative to the prior art, while erosion resistance is maintained through strongly interconnected metallic particles. The strength of the mix is maintained through the use of a bi-modal distribution of hBN particles. As noted above, a first fine particle size composite is formed with about 40-60% by volume metallic Ni alloy that maintains good connectivity between metallic particles. This composite structure is then used as the matrix around larger dimension hBN particles. The result is that good connectivity is maintained between the metallic particles resulting in good erosion resistance, while being able to include an unprecedented volume fraction of hBN in the range of 75-80%. The desired low volumetric wear ratio of blade to seal material is achieved through this reduction in metal content of the seal.

Low gas permeability and roughness are achieved by creating a structure that is filled with hBN and takes advantage of a fine distribution of constituents.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An air seal for use with rotating parts in a gas turbine engine, wherein said air seal comprises;

a matrix of agglomerated fine hexagonal boron nitride powder, the particles of which having a first dimension and of a fine metallic alloy powder, the particles of which having a second dimension, and an hexagonal boron nitride powder, the particles of which having a third dimension that is greater than said first dimension, wherein said hexagonal boron nitride powder is mixed with said matrix.

2. The air seal of claim 1 wherein said first dimension is between 1-10 microns.

3. The air seal of claim 1 wherein said second dimension is between 1-25 microns.

4. The air seal of claim 1 wherein said third dimension is between 15-100 microns.

5. The air seal of claim 4 wherein said third dimension is between 20-75 microns.

6. The air seal of claim 1 wherein a ratio between the amount by volume of hexagonal boron nitride to metallic alloy is about 40-60% in the matrix.

7. The air seal of claim 1 wherein said metallic alloy is a nickel based alloy.

8. The air seal of claim 1 wherein a total percent by volume of hexagonal boron nitride is greater than 75%.

9. A gas turbine engine comprising;

relatively rotating parts, an air seal disposed between relatively rotating parts, wherein said air seal includes;

a matrix of agglomerated fine hexagonal boron nitride powder, the particles of which having a first dimension and of a fine metallic alloy powder, the particles of which having a second dimension, and an hexagonal boron nitride powder, the particles of which having a third dimension that is greater than said first dimension, wherein said hexagonal boron nitride powder is mixed with said matrix.

10. The gas turbine engine of claim 9 wherein said first dimension is between 1-10 microns.

11. The gas turbine engine of claim 9 wherein said second dimension is between 1-25 microns.

12. The gas turbine engine of claim 9 wherein said third dimension is between 15-100 microns.

13. The gas turbine engine of claim 12 wherein said third dimension is between 20-75 microns.

14. The gas turbine engine of claim 9 wherein a ratio between the amount by volume of hexagonal boron nitride to metallic alloy is about 40-60% in the matrix.

15. The gas turbine engine of claim 9 wherein said metallic alloy is a nickel based alloy.

16. The gas turbine engine of claim 9 wherein a total % by volume of hexagonal boron nitride of said air seal is greater than 75%.

17. A method of creating an air seal on a gas turbine engine part comprises;

agglomerating a matrix of fine hexagonal boron nitride powder, the particles of which having a first dimension and of a fine metallic alloy powder, the particles of which having a second dimension, and mixing with said matrix an hexagonal boron nitride powder, the particles of which having a third dimension that is greater than said first dimension.

18. The method of claim 17 comprising the step of;

spraying said blended matrix and hexagonal boron nitride powder onto said gas turbine engine part.

19. The method of claim 17 wherein powders are separately fed to the spray torch and said mixing step is achieved during spraying of each of said matrix and said hexagonal boron nitride powder on said gas turbine part.

20. The method of claim 17 wherein said metallic alloy is a nickel alloy.

21. The method of claim 17 wherein said hexagonal boron nitride particles having a third dimension with said fine hexagonal boron nitride powder and said fine metallic alloy powder while agglomerating said matrix.

* * * * *